United States Patent [19]

Aune et al.

[11] Patent Number: 4,845,343

[45] Date of Patent: Jul. 4, 1989

[54] ELECTRICAL DEVICES COMPRISING FABRICS

[75] Inventors: Ted M. Aune, Fremont; Paul B. Germeraad, Menlo Park; Randolph W. Chan, Palo Alto, all of Calif.

[73] Assignee: Raychem Corporation, Menlo Park, Calif.

[21] Appl. No.: 277,521

[22] Filed: Nov. 28, 1988

Related U.S. Application Data

[63] Continuation of Ser. No. 108,257, Oct. 13, 1987, abandoned, which is a continuation-in-part of Ser. No. 735,428, May 17, 1985, Pat. No. 4,700,054, which is a continuation-in-part of Ser. No. 552,649, Nov. 17, 1983, abandoned.

[51] Int. Cl.[4] ..... H05B 3/34

[52] U.S. Cl. ..... 219/545; 219/529; 219/549; 29/611

[58] Field of Search ..... 219/545, 549, 528, 529, 219/553; 264/103, 104; 338/22 R, 208, 210; 29/610.1, 611

[56] References Cited

U.S. PATENT DOCUMENTS

| | | | |
|---|---|---|---|
| 2,473,183 | 7/1947 | Watson | 219/46 |
| 3,359,524 | 12/1967 | Gallacher et al. | 338/212 |
| 3,400,254 | 9/1968 | Takamori | 219/549 |
| 3,484,585 | 12/1969 | Morey | 219/545 X |
| 3,513,297 | 5/1970 | Jordan | 219/545 |
| 3,751,620 | 8/1973 | Yuasa | 219/211 |
| 3,781,526 | 12/1973 | Damron | 219/553 X |
| 3,808,403 | 4/1974 | Kanaya et al. | 219/528 |
| 4,017,715 | 4/1977 | Whitney et al. | 219/553 X |
| 4,246,468 | 1/1981 | Horsma | 219/553 |
| 4,272,471 | 1/1981 | Walker | 264/104 |
| 4,309,596 | 1/1982 | Crowley | 219/549 |
| 4,314,145 | 2/1982 | Horsma | 219/553 |
| 4,329,726 | 5/1982 | Middleman et al. | 338/22 R X |
| 4,330,703 | 5/1982 | Horsma et al. | 219/553 X |
| 4,330,704 | 5/1982 | Jensen | 219/553 |
| 4,421,582 | 12/1983 | Horsma et al. | 219/553 X |
| 4,429,216 | 1/1984 | Brigham | 219/528 |
| 4,444,708 | 4/1984 | Gale et al. | 264/105 |
| 4,459,473 | 7/1984 | Kamath | 219/553 |
| 4,485,297 | 11/1984 | Grise et al. | 219/528 |
| 4,523,086 | 6/1985 | Eilentropp | 219/545 X |
| 4,700,054 | 10/1987 | Triplett et al. | 219/545 |

*Primary Examiner*—E. A. Goldberg
*Assistant Examiner*—M. M. Lateef
*Attorney, Agent, or Firm*—Timothy H. P. Richardson; Herbert G. Burkard

[57] ABSTRACT

An electrical heater which includes a fabric prepared from electrodes and an elongate resistive heating element which is composed of a conductive polymer, preferably a PTC conductive polymer, to render the heater self-regulating. The fabric is laminated to, and preferably embedded in, a sheet of an insulating polymer, particularly a non-tracking insulating polymer.

20 Claims, 1 Drawing Sheet

ELECTRICAL DEVICES COMPRISING FABRICS

CROSS REFERENCE TO RELATED APPLICATION

Figure 1:
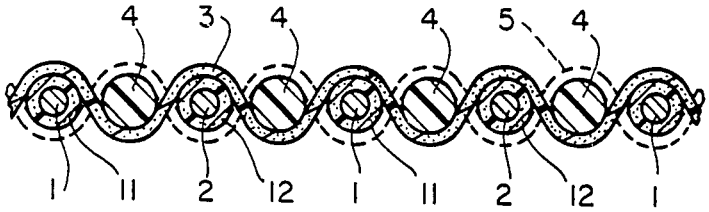

This application is a file wrapper continuation of application Ser. No. 108,257, filed Oct. 13, 1987, which is a continuation-in-part of commonly assigned application Ser. No. 735,428 filed May 17, 1985, by Jensen, Triplett, Skipper, Aune, McKinley, Germeraad and Chan, now U.S. Pat. No. 4,700,054, issued Oct. 13, 1987 which is itself a continuation-in-part of application Ser. No. 552,649 filed Nov. 17, 1983, by Jensen and Triplett, now abandoned.

BACKGROUND OF THE INVENTION

1. Field of the Invention

This invention relates to fabrics having useful electrical properties.

2. Introduction to the Invention

Compositions which have a positive temperature coefficient of resistance ("PTC compositions") are known. They can be composed of ceramic material, eg. a doped barium titanate, or a conductive polymer material eg. a dispersion of carbon black or other particulate conductive filler in a crystalline polymer. The term PTC is generally used (and is so used in this specification) to denote a composition whose resistivity increases by a factor of at least 2.5 over a temperature range of 14° C. or by a factor of at least 10 over a temperature range of 100° C., and preferably both. The term switching temperature (or $T_s$) is generally used (and is so used in this specification) to denote the temperature at which the sharp increase in resistivity takes place, as more precisely defined in U.S. Pat. No. 4,237,441. Materials, in particular conductive polymer compositions, which exhibit zero temperature coefficient (ZTC) behavior are also known. In electrical devices which contain a PTC element and a ZTC element, the term ZTC is generally used (and is so used in this specification) to denote an element which does not exhibit PTC behavior at temperature below the $T_s$ of the PTC element; thus the ZTC element can have a resistivity which increases relatively slowly, or which is substantially constant, or which decreases slowly, at temperatures below the $T_s$ of the PTC element. Materials, in particular conductive polymer compositions, which exhibit negative temperature coefficient (NTC) behavior are also known. For further details of conductive polymer compositions and devices comprising them, reference may be made for example to U.S. Pat. Nos. 2,952,761, 2,978,665, 3,243,753, 3,351,882, 3,571,777, 3,757,086, 3,793,716, 3,823,217, 3,858,144, 3,861,029, 3,950,604, 4,017,715, 4,072,848, 4,085,286, 4,117,312, 4,177,376, 4,177,446, 4,188,276, 4,237,441, 4,238,812, 4,242,573, 4,246,468, 4,250,400, 4,255,698, 4,242,573, 4,271,350, 4,272,471, 4,276,466, 4,304,987, 4,309,596, 4,309,597, 4,314,230, 4,314,231, 4,315,237, 4,317,027, 4,318,881, 4,327,351, 4,330,704, 4,334,351, 4,352,083, 4,361,799, 4,388,607, 4,398,084, 4,413,301, 4,425,397, 4,426,339, 4,426,633, 4,427,877, 4,435,639, 4,429,216, 4,442,139, 4,459,473, 4,481,498, 4,476,450, 4,502,929, 4,514,620, 4,517,449, 4,545,926, 4,562,313, 4,571,481, 4,574,188, 4,582,983, and 4,659,913; J. Applied Polymer Science 19, 813–815 (1975), Klason and Kubat; Polymer Engineering and Science 18, 649–653 (1978), Narkis et al; and commonly assigned U.S. Ser. Nos. 601,424 now abandoned, published as German OLS No. 2,634,999; 732,792 (Van Konynenburg et al), now abandoned, published as German OLS No. 2,746,602; 798,154 (Horsma et al), now abandoned, published as German OLS No. 2,821,799; 134,354 (Lutz), now abandoned; 141,984 (Gotcher et al), published as European Application No. 38,718; 141,988 (Fouts et al) now abandoned, published as European application No. 38,718, 141,989 (Evans), published as European application No. 38,713, 150,909 (Sopory) now abandoned, published as UK application Nos. 2,076,106A, 184,647 (Lutz) now abandoned, 250,491 (Jacobs et al) published as European application No. 63,440, 272,854 and 403,203 (Stewart et al),published as European patent application No. 67,679, 274,010 (Walty et al), 300,709 and 423,589 (Van Konynenburg et al), published as European application No. 74,281, 369,309 (Midgley et al), 483,633 (Wasley), 509,897 and 598,048 (Masia et al) published as European application No. 84,304,502.2, 534,913 (McKinley) now abandoned, published as European application No. 84,306,456.9, 552,649 (Jensen et al) now abandoned, published as European application No. 84,307,984.9, 573,099 (Batliwalla et al) and 904,736, published as UK patent Nos. 1,470,502 and 1,470,503, and the three commonly assigned applications filed Sept. 14, 1984, Ser. Nos. 650,918, 650,920 and 650,919 (MP0959, 961 and 962). The disclosure of each of the patents, publications and applications referred to above is incorporated herein by reference.

SUMMARY OF THE INVENTION

There are serious limitations in the known techniques for making electrical devices which contain PTC and/or ZTC elements composed of ceramic or conductive polymer materials. Ceramic materials are brittle and are difficult to shape, particularly when large or complex shapes are needed. Conductive polymers can be manufactured in a wide variety of shapes, but especially with PTC materials, close control is needed to ensure adequate uniformity; it is yet more difficult, if not impossible, to produce a predetermined variation in properties in different parts of an article. When a heat-shrinkable PTC conductive polymer article is required, there is the difficulty that when a PTC conductive polymer sheet is rendered heat-shrinkable (by stretching the cross-linked sheet above its melting point and then cooling it in the stretched state), the PTC of the heat-shrinkable sheet is often substantially smaller than that of the original sheet; this limits the stretch ratio that can be employed and, therefore, the available recovery.

In accordance with the present invention, we have now discovered that a wide range of electrical heaters can be easily and economically manufactured through the application (or adaptation) of known fabric-making techniques (particularly weaving, but including also, for example, knitting and braiding) to manufacture heaters which comprise elongate elements of at least two different types, one type comprising one of the electrodes and the other type (or one of the other types, if there are three or more different types) comprising a component composed of a material having a relatively high resistivity. Generally both the electrodes will be in the form of elongate elements which form part of the same fabric, and the invention will chiefly be described by reference to such fabrics. However, the invention also includes heaters in which the electrodes form part of different fabrics and heaters in which one of the electrodes is not part of a fabric, e.g. is a solid, stranded or apertured laminar, tape-like or wire-like element.

The fabric must contain at least one elongate element which comprises a component composed of a material which has sufficient resistivity, e.g. greater than $10^{-5}$ ohm·cm, particularly greater than $10^{-3}$ ohm·cm, to provide an effect which would not be obtained if the element consisted essentially of a metal. For example the component can be electrically resistive, in order to provide a heating effect; or electrically insulating (including insulating and non-tracking), to separate conductive components; or thermally responsive (e.g. heat-recoverable or thermally-activated adhesive).

The novel heaters must comprise a resistive element which generates heat when the electrodes of the heater are connected to a power supply. The resistive element can be provided by (or by a part of) one of the elongate elements which form part of the fabric, and/or by a separate element, e.g. a planar element which is adjacent to, the fabric or in which the fabric is wholly or partially embedded. The resistive element preferably exhibits PTC behavior such as may result from at least part of the element being composed of a PTC material whose resistivity decreases sharply at some elevated temperature. Particularly useful resistive elements are composed of a conductive polymer which comprises a polymeric component and a particulate conductive filler dispersed in the polymeric component. Particularly important embodiments of the invention are those in which:

(A) at least one of the elongate elements in the fabric is an electrode, e.g. a metallic wire, which is a coated with a PTC material, particularly a PTC conductive polymer; such heaters preferably also comprise a ZTC material, particularly a conductive polymer, in which the fabric is embedded, so that current passing between the electrodes passes through the PTC and ZTC materials;

(B) at least one of the elongate elements is a resistive element which preferably comprises a PTC material, e.g. an element obtained by melt-extruding a PTC or ZTC conductive polymer; such heaters preferably comprise a fabric which comprises parallel metal electrodes and insulating elements running in one direction and the resistive elements running at right angles thereto;

(C) the fabric comprises parallel electrodes and insulating elements running in one direction, and insulating elements running at right angles thereto, and the resistive element is a planar element composed of a conductive polymer, preferably a PTC conductive polymer, in which the fabric is embedded; and (D) the fabric comprises elongate elements which are made of an insulating and non-tracking material, e.g one which is based on a polysiloxane, an ethylene/vinyl acetate copolymer or a thermoplastic rubber, and which preferably comprises a non-tracking material, e.g. alumina trihydrate and/or an iron oxide.

In the further development of the heaters described above and of other fabric heaters comprising elongate elements having outer surfaces which are composed of a conductive polymer and across which current flows, we have found that the performance of such heaters can deteriorate substantially, particularly when the heater has been subjected to flexing, apparently due to increases in contact resistance and/or to physical separation of the conductive elements. We have found that the performance of such heaters can be improved by laminating at least one, and preferably both, of the faces of the fabric heater to a layer of insulating polymeric material with the aid of heat under conditions such that (1) the polymeric material flows into the fabric heater and (2) the outer surfaces of said elongate elements are deformed to provide improved electrical contact with adjacent surfaces, e.g. of wire electrodes. The conditions used in the lamination must not be such as to cause excessive melting or flowing of the conductive polymer which would interfere with the desired performance of the heater. Thus the insulating material should melt at a temperature lower than the conductive polymer (and, if necessary, be cross-linked after the lamination step so that it does not flow during use of the heater) and/or the conductive polymer should be cross-linked prior to the lamination, in order to prevent excessive deformation of the conductive polymer during the lamination. Particularly useful heaters are obtained when the insulating material is a non-tracking material, as described for example in U.S. Pat. Nos. 4,399,604 and 4,470,898, the disclosures of which are incorporated herein by reference.

In another aspect, therefore, the present invention provides an electrical sheet heater which comprises (1) a fabric comprising a plurality of elongate elements which are interlaced together in an ordered array, said elongate elements comprising (a) a plurality of first electrodes which are substantially parallel to each other, and which are electrically connected to each other;

(b) a plurality of second electrodes which are substantially parallel to each other and to the first electrodes, which are electrically connected to each other, and which are spaced apart from the first electrodes; and (c) a plurality of resistive heating elements which are composed of a conductive polymer, which are substantially parallel to each other and at an angle to the electrodes, and through which current passes when the first and second electrodes are connected to a power source;

(2) means for connecting the first electrodes and second electrodes to a power source; and (3) a laminar matrix which is composed of an electrically insulating material comprising an organic polymer and within which said fabric (1) is embedded.

A preferred process for making such a heater comprises (1) weaving the fabric from elongate elements which comprise (a) in a first direction, the first electrodes, the second electrodes, and elongate elements which are composed of a thermoplastic, electrically insulating material comprising an organic polymer and which lie between the first and second electrodes, and (b) in a second direction, elongate elements which are composed of a conductive polymer and elongate elements composed of a thermoplastic, electrically insulating material comprising an organic polymer;

(2) placing the fabric between two sheets which are composed of a thermoplastic, electrically insulating material comprising an organic polymer; and (3) applying heat and pressure to the sheets and the fabric so that thermoplastic materials soften and flow to form the laminar matrix having the fabric embedded therein.

The electrodes used in this invention are usually of metal, e.g. copper or nickel-coated copper, for example a solid or stranded wire. In one preferred class of heaters, at least one of the electrodes is electrically surrounded by a PTC element, preferably a PTC conductive polymer element. Usually the PTC element will be melt-shaped, preferably melt-extruded, preferably so that it physically surrounds the electrode as a uniform coating throughout its length; however, other methods of forming the PTC element, e.g. dip-coating, and other geometric arrangements, are possible. In other preferred heaters, the fabric comprises an elongate resistive element which comprises, and preferably consists essentially of, a PTC material, preferably a fibrous element (mono-filament or multifilament) made by melt-extruding a PTC conductive polymer. The PTC fiber or coating can vary in thickness and/or resistivity radially and/or longitudinally. Alternatively, the PTC element can alternate radially and/or longitudinally with polymeric elements having different electrical properties, e.g. which exhibit a different type of PTC behavior, which are electrically insulating, or which have a resistance which is much higher than the resistance of the PTC element at room temperature, so that at least when the device is at relatively low temperatures, substantially all the current between the electrodes passes through the PTC element. The PTC element can be in direct physical contact with the electrode or can be separated therefrom by a layer of ZTC material, for example a low resistivity conductive polymer, which may be applied to the electrode as a conductive paint. The dimensions of the PTC element and the resistivity and other properties of the PTC composition should be correlated with the other elements of the device, but those skilled in the art will have no difficulty, having regard to their own knowledge (e.g. in the documents referenced herein) and the disclosure herein, in selecting suitable PTC elements. Suitable polymers include polyethylene and other polyolefins; copolymers of one or more olefins with one or more polar comonomers e.g. ethylene/vinyl acetate, ethylene/acrylic acid and ethylene/ethylacrylate copolymers; fluoropolymers, e.g. polyvinylidene fluoride and ethylene/tetrafluoroethylene copolymers; and polyarylene polymers, e.g. polyether ketones; and mixtures of such polymers with each other and/or with elastomers to improve their physical properties.

The heaters can also comprise an elongate ZTC conductive polymer element. This ZTC element can be of uniform composition or can comprise discrete subelements; for example it may be desirable to coat an electrode or a PTC element surrounding an electrode with a first ZTC conductive polymer in order to provide improved electrical and physical contact to a second ZTC conductive polymer. Alternatively or additionally a ZTC material can be coated on the junctions between the elongate elements to provide improved electrical contact. The dimensions of the ZTC electrical element and the resistivity and other properties of the ZTC conductive polymers preferably used for it should be correlated with the other elements of the device, but those skilled in the art will have no difficulty, having regard to their own knowledge (e.g. in the documents referenced herein) and the disclosure herein, in selecting suitable ZTC elements. Suitable polymers for the ZTC material include copolymers of ethylene with one or more polar copolymers, e.g. ethyl acrylate and vinyl acetate.

The elongate elements can be formed into a fabric by any method which results in an ordered array of interlaced elongate elements. Weaving is the preferred method, but knitting, braiding etc. can be used in suitable cases. When it is stated herein that the first and second electrodes are "substantially parallel" to each other, this includes localized variation from a strictly parallel configuration such as is present for example in a knitted fabric. Similarly when it is stated that other elements are substantially at right angles to the electrodes, this includes localized variation from such a configuration. The density of the weave (or other form of interlacing) can be selected in order to provide the desired power output or other property. Similarly, the density of the weave can be varied from one area to another to provide a desired variation, eg. of at least 10% or at least 25%, in one or more properties from one discrete area (which may be, for example, at least 5% or at least 15% of the total area) to another. Triaxial weaving can be employed.

In order to pass current through the device, the electrodes must of course be connected to a power source, which may be DC or AC, e.g. relatively low voltage, e.g. 12, 24 or 48 volts, or conventional line voltages of 110, 220, 440 or 600 volts. The various components of the device must be selected with a view to the power source to be employed. When the electrodes are elongate electrodes, they may be powered from one end or from a number of points along their lengths; the former is easier to provide, but the latter results in more uniform power generation.

The heater prior to lamination may include, at least in selected areas thereof, a non-conductive element, which may be an interlaced elongate element, which provides desired properties during the lamination (eg. by melting and flowing, or assisting satisfactory lamination) and/or in the final product, eg. an elongate element composed of glass fibers, which provides stiffness or other desired physical properties, or composed of a non-tracking material in order to inhibit the deleterious effects of arcing. The heater can be laminated to, or can comprise, thermally responsive member, for example a layer of a hot melt adhesive or a mastic; a thermochromic paint; or a component which foams when heated.

The electrodes generally run in one direction in the fabric (which may be the warp or the weft, depending on the ease of weaving). The electrodes can be powered from one end, in which case they will normally have a serpentine shape and be insulated from each other at the cross-over points. Alternatively the fabric can be woven so that each of the electrodes is or can be exposed at regular intervals along the fabric, eg. each time it changes direction, thus permitting the exposed portions to be bussed together by some bussing means which permits the desired shrinkage to take place. Generally, the exposed portions of the first electrodes will be joined together along one edge of the fabric and the exposed ends of the second electrodes will be joined together along the opposite edge of the fabric.

The thermal properties of the device and of the surroundings are important in determining the behavior of the device. Thus the device can comprise, or be used in conjunction with, a thermal element which helps to spread heat uniformly over the device, eg. a metal foil layer, or which reduces the rate at which heat is removed from the device, eg. a layer of thermal insulation such as a foamed polymer layer.

The fabric may be laminated with a material to render it impermeable, to strengthen it, to improve heat dissipation or otherwise to alter its electrical or physical properties. Instead of or in addition to such lamination, a material may be applied to improve electrical contact between the first and second electrodes on the one hand and the resistive element on the other hand. A suitable material for this purpose comprises a conductive paint. Electrical contact may also be improved by subjecting the fabric or the laminate to compression, for example by passing it through nip rollers.

One may alter the electrical properties of the heater by incorporating into it two or more PTC materials having different temperature coefficients of resistance. For example, one PTC material may be present as a PTC fiber and another as a jacket encasing a wire electrode. Alternatively the heater can contain a PTC fiber comprising two or more materials having different temperature coefficients of resistance, e.g. a PTC fiber in tape form whose orientation is fixed relative to electrodes with which it is interlaced. Tape-like fibers have the advantage of increased contact area with the electrodes. Thus the tape may comprise a strip of material having a high switching temperature (a temperature or range of temperatures at which a substantial change in resistivity occurs) laminated to a strip of material having a lower switching temperature. Such a tape can be interlaced as part of a fabric such that, say, the material of lower switching temperature contacts only phase electrodes and the material of higher switching temperature contacts only neutral electrodes. The result is a much sharper switching temperature than would be achieved if either of the materials were used separately.

DESCRIPTION OF THE DRAWINGS AND THE PREFERRED EMBODIMENTS

Referring now to the drawing, FIG. 1 is a diagrammatic, partial cross-sectional side view of a heater which is suitable for lamination to sheets of non-conductive polymeric material in order to make a heater of the invention. It shows electrodes 1 of one polarity, each surrounded by a ZTC conductive polymer element 11, and parallel electrodes 2 of opposite polarity, each surrounded by a ZTC conductive polymer element 21. The electrodes are woven into a fabric with non-conductive, non-tracking filaments 4 between them, and with PTC filaments 3 and non-conductive non-tracking filaments 5 at right angles to them.

Figure 2:
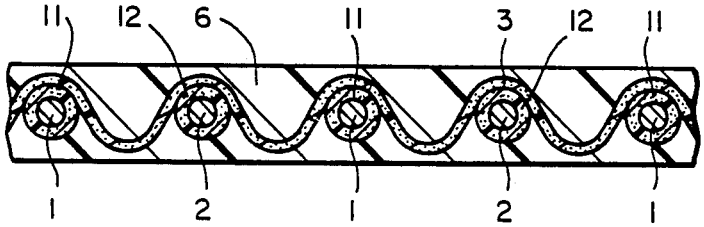

FIG. 2 is a diagrammatic partial cross-sectional side view of the device of FIG. 1 after it has been laminated between two sheets of the same non-conductive, non-tracking material as the filaments 4 and 5, under conditions which cause the sheets and the filaments to melt and coalesce to form a matrix 6 in which the fabric heater is embedded.

The invention is illustrated by the following Examples.

EXAMPLE 1

The non-tracking material used in this Example comprised iron oxide and alumina trihydrate dispersed in an ethylene/vinyl acetate copolymer, as described in U.S. Pat. No. 4,399,064. The filaments of this material were 0.020 inch in diameter. The PTC conductive polymer filaments were 0.040 inch in diameter and were prepared by melt extruding a composition which comprises carbon black dispersed in high density polyethylene. The electrodes were nickel-coated copper stranded wires which were 0.020 inch in diameter and were coated with a thin ZTC layer of a graphite-containing polymer thick film ink.

A fabric was woven, with the coated electrodes separated by non-tracking filaments running in one direction, and PTC filaments separated by non-tracking filaments running at right angles to the first direction. The center-to-center separation of adjacent electrodes was 0.25 inch, with a single non-tracking filament midway between them. The center-to-center separation of adjacent PTC filaments was 0.125 inch, with a single non-tracking filament midway between them.

A sample of the fabric was placed between two sheets of the non-tracking material, each 0.15 inch thick, leaving the edges of the fabric exposed, and the assembly was pressed at about 275° F. and a pressure of about 25 psi for about 5 minutes, thus causing the filaments and sheets of the non-tracking material to melt and coalesce into a substantially continuous matrix of the material. The resulting structure was then irradiated to a dose of about 5 Mrad.

Alternate conductors on one of the exposed edges of the laminate were connected to a busbar which was insulated from the other conductors. The other conductors were connected to a second busbar on the other exposed edge. When the busbars were connected to a power source, current passed between the conductors through the PTC filaments, thus generating heat.

EXAMPLE 2

A PTC fiber having a diameter of 0.04 inch was made by melt-extruding a PTC conductive polymer composition comprising carbon black dispersed in a mixture of polyethylene and an ethylene/ethyl acrylate copolymer, followed by irradiation to a dosage of about 7 Mrads to cross-link the polymer. A fabric was then woven in which the warp consisted of commercially available rayon fibers and, at intervals of 0.4 inch, three contiguous wires, each a 30 AWG nickel-coated copper solid wire which had been coated with a conductive paint containing graphite (Electrodag 502), and the weft consisted of the same rayon fibers and, at intervals of about 0.11 inch, a PTC fiber prepared as described above.

The resulting fabric was placed between two sheets of an ethylene/propylene rubber (sold by Uniroyal under the trade name TPR 8222B) and the assembly was laminated between silicone pads at 450° F. for one minute, using minimum pressure.

The resulting product was trimmed, and the wires exposed along the edges of the heater. The heater had a stable resistance and a low Linearity Ratio (ratio of resistance at 100 volts AC to resistance at 0.04 volts AC) of less than 1.1, even after flexing.

We claim:

1. An electrical sheet heater which comprises (1) a fabric comprising a plurality of elongate elements which are interlaced together in an ordered array, said elongate elements comprising (a) a plurality of first electrodes which are substantially parallel to each other, and which are electrically connected to each other;

(b) a plurality of second electrodes which are substantially parallel to each other and to the first electrodes, which are electrically connected to each other, and which are spaced apart from the first electrodes; and (c) a plurality of resistive heating elements which are composed of a conductive polymer, which are substantially parallel to each other and at an angle to the electrodes, and through which current passes when the first and second electrodes are connected to a power source;

(2) means for connecting the first electrodes and second electrodes to a power source; and (3) a laminar matrix which is composed of an electrically insulating material comprising an organic polymer and within which said fabric (1) is embedded.

2. A heater according to claim 1 wherein at least the first electrodes comprise a metal conductor which is coated by a conductive polymer exhibiting ZTC behavior.

3. A heater according to claim 1 wherein the heating elements comprise a conductive polymer exhibiting PTC behavior.

4. A heater according to claim 1 wherein the heating elements are in the form of filaments which are composed of a conductive polymer exhibiting PTC behavior and which run in a direction substantially at right angles to the electrodes.

5. A heater according to claim 1 wherein at least the first electrodes comprise a metal conductor which is coated by a conductive polymer exhibiting PTC behavior.

6. A heater according to claim 5 wherein the heating elements are in the form of filaments which are composed of a conductive polymer exhibiting ZTC behavior and which run in a direction substantially at right angles to the electrodes.

7. A heater according to claim 3 wherein the electrically insulating material has a melting point lower than the $T_s$ of the PTC conductive polymer and has been cross-linked.

8. A heater according to claim 3 wherein the electrically insulating material has a melting point higher than the $T_s$ of the PTC conductive polymer and the PTC conductive polymer has been cross-linked.

9. A heater according to claim 1 wherein the electrically insulating material contains an anti-tracking material.

10. A method of making a heater as defined in claim 1 which comprises (1) weaving the fabric from elongate elements which comprise (a) in a first direction, the first electrodes, the second electrodes, and elongate elements which are composed of a thermoplastic, electrically insulating material comprising an organic polymer and which lie between the first and second electrodes, and (b) in a second direction, elongate elements which are composed of a conductive polymer and elongate elements composed of a thermoplastic, electrically insulating material comprising an organic polymer;

(2) placing the fabric between two sheets which are composed of a thermoplastic, electrically insulating material comprising an organic polymer; and (3) applying heat and pressure to the sheets and the fabric so that thermoplastic materials soften and flow to form the laminar matrix having the fabric embedded therein.

11. A method according to claim 10 wherein at least the first electrodes comprise a metal conductor which is coated by a conductive polymer exhibiting ZTC behavior.

12. A method according to claim 10 wherein the heating elements comprise a conductive polymer exhibiting PTC behavior.

13. A method according to claim 10 wherein the heating elements are in the form of filaments which are composed of a conductive polymer exhibiting PTC behavior and which run in a direction substantially at right angles to the electrodes.

14. A method according to claim 10 wherein at least the first electrodes comprise a metal conductor which is coated by a conductive polymer exhibiting PTC behavior.

15. A method according to claim 14 wherein the heating elements are in the form of filaments which are composed of a conductive polymer exhibiting ZTC behavior and which run in a direction substantially at right angles to the electrodes.

16. A method according to claim 12 wherein the electrically insulating material has a melting point lower than the $T_s$ of the PTC conductive polymer and has been cross-linked.

17. A method according to claim 12 wherein the electrically insulating material has a melting point higher than the $T_s$ of the PTC conductive polymer and the PTC conductive polymer has been cross-linked.

18. A method according to claim 10 wherein the electrically insulating material contains an anti-tracking material.

19. A method according to claim 18 wherein the anti-tracking material is alumina trihydrate.

20. A heater according to claim 9 wherein the anti-tracking material is alumina trihydrate.

* * * * *